US012692751B2

(12) United States Patent
Tissot

(10) Patent No.: US 12,692,751 B2
(45) Date of Patent: Jul. 28, 2026

(54) DRILL BIT WITH EFFECTIVE SIDE RAKE FOR WEIGHT ON BIT REDUCING EFFECT

(71) Applicant: VAREL ENERGY OIL FIELD EQUIPMENT TRADING L.L.C, Dubai (AE)

(72) Inventor: Vincent Tissot, Dubai (AE)

(73) Assignee: VAREL ENERGY OIL FIELD EQUIPMENT TRADING L.L.C, Dubai (AE)

( * ) Notice: Subject to any disclaimer, the term of this patent is extended or adjusted under 35 U.S.C. 154(b) by 0 days.

(21) Appl. No.: 19/347,073

(22) Filed: Oct. 1, 2025

(65) Prior Publication Data

US 2026/0139551 A1 May 21, 2026

Related U.S. Application Data

(60) Provisional application No. 63/721,069, filed on Nov. 15, 2024.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673
See application file for complete search history.

(56) References Cited

U.S. PATENT DOCUMENTS

| | | | | |
|---|---|---|---|---|
| 5,649,604 | A * | 7/1997 | Fuller | E21B 10/43 175/431 |
| 7,441,612 | B2 | 10/2008 | Durairajan | |
| 8,327,955 | B2 | 12/2012 | Patel | |
| 9,016,409 | B2 | 4/2015 | Zhang | |
| 9,366,090 | B2 | 6/2016 | Azar | |
| 9,556,683 | B2 | 1/2017 | Simmons | |
| 9,752,387 | B2 | 9/2017 | Richert | |
| 10,246,945 | B2 | 4/2019 | Boehm | |
| 10,753,155 | B2 | 8/2020 | Maurstad | |
| 11,480,016 | B2 | 10/2022 | Silveus, III | |
| 11,802,444 | B2 | 10/2023 | Pelfrene | |
| 2010/0307829 | A1* | 12/2010 | Patel | E21B 10/5673 175/428 |
| 2010/0326741 | A1* | 12/2010 | Patel | B24D 99/005 156/60 |
| 2014/0262544 | A1* | 9/2014 | Azar | E21B 10/43 175/430 |
| 2014/0262545 | A1* | 9/2014 | Azar | E21B 10/55 175/430 |

(Continued)

*Primary Examiner* — David Carroll

(57) ABSTRACT

A bit for drilling a wellbore includes: a body; and a crown. The crown includes: a cone section and a shoulder section; a plurality of blades protruding from the body, each blade extending from a center of the crown and across the shoulder section; and a row of superhard cutters mounted along each blade, each cutter mounted in a pocket formed adjacent to a leading edge of the blade. Each row has a plurality of inner cutters located in the cone section. Each inner cutter has an inclined face oriented to decline toward the center of the crown for creating an effective negative side rake angle while drilling with the drill bit and a weight on bit (WOB) reducing effect. Each of the rest of the cutters are oriented such that an overall effect for the bit is the WOB reducing effect.

19 Claims, 6 Drawing Sheets

(56) References Cited

U.S. PATENT DOCUMENTS

| | | | | |
|---|---|---|---|---|
| 2015/0233185 | A1* | 8/2015 | Maouche | E21B 10/5673 51/307 |
| 2019/0017328 | A1 | 1/2019 | Reese | |
| 2022/0220809 | A1* | 7/2022 | Pelfrene | E21B 10/43 |

* cited by examiner

DRILL BIT WITH EFFECTIVE SIDE RAKE FOR WEIGHT ON BIT REDUCING EFFECT

BACKGROUND OF THE DISCLOSURE

Field of the Disclosure

The present disclosure generally relates to a drill bit with effective side rake for weight on bit reducing effect.

Description of the Related Art

U.S. Pat. No. 5,649,604 discloses a rotary drill bit including a bit body having a shank for connection to a drill string, a plurality of cutters mounted on the bit body, each cutter having a cutting face, and means for supplying drilling fluid to the surface of the bit body to cool and clean the cutters. At least some of the cutters are lateral cutters located to act sideways on the formation being drilled, and the cutting faces of such lateral cutters are orientated to exhibit negative side rake and negative top rake with respect to the surface of the formation. The negative side rake angle is greater than 20° and may be as much as 90°, and the negative top rake angle is also more than 20°. A single cutter may include two cutting faces at different negative side rake angles, e.g. the cutter may comprise a generally cylindrical substrate formed at one end with two oppositely inclined surfaces meeting along a ridge, a facing table of polycrystalline diamond being bonded to the substrate surfaces and extending over the ridge.

U.S. Pat. No. 7,441,612 discloses a fixed cutter drill bit and a method for designing a fixed cutter drill bit including simulating the fixed cutter drill bit drilling in an earth formation. A performance characteristic of the simulated fixed cutter drill bit is determined. A side rake angle distribution of the cutters is adjusted at least along a cone region of a blade of the fixed cutter drill bit to change the performance characteristic of the fixed cutter drill bit.

U.S. Pat. No. 8,327,955 discloses a superabrasive cutter including a superabrasive table having a cutting face in non-perpendicular orientation with respect to a longitudinal axis of the cutter. A superabrasive cutter having a cutting face of a superabrasive table in non-parallel orientation to a back surface thereof.

U.S. Pat. No. 9,016,409 discloses a cutting tool cutting tool including a tool body having a plurality of blades extending radially therefrom; and a plurality of rotatable cutting elements mounted on at least one of the plurality of blades, wherein the plurality of rotatable cutting elements are mounted on the at least one blade in a nose and/or shoulder region of the cutting tool at a side rake angle ranging from about 10 to about 30 degrees or −10 to about −30 degrees.

U.S. Pat. No. 9,366,090 discloses a drill bit for drilling a borehole in earth formations including a bit body having a bit axis and a bit face; a plurality of blades extending radially along the bit face; and a plurality of cutting elements disposed on the plurality of blades. The plurality of cutting elements may include: at least one cutter including a substrate and a diamond table having a substantially planar cutting face; and at least two conical cutting elements including a substrate and a diamond layer having a conical cutting end. In a rotated view of the plurality of cutting elements into a single plane, the at least one cutter may be located a radial position from the bit axis that is intermediate the radial positions of the at least two conical cutting elements.

U.S. Pat. No. 9,556,683 discloses earth boring tools with a plurality of fixed cutters having side rake or lateral rakes configured for improving chip removal and evacuation, drilling efficiency, and/or depth of cut management as compared with conventional arrangements.

U.S. Pat. No. 9,752,387 discloses a cutting element for an earth-boring tool including at least one volume of superabrasive material on a substrate. The volume of superabrasive material includes a first planar surface and a second planar surface oriented at an angle relative to the first planar surface and intersecting the first planar surface along an apex. The first planar surface has a circular or oval shape having a first maximum diameter, and the second planar surface has a circular or oval shape having a second maximum diameter. The apex has a length less than the first maximum diameter and the second maximum diameter. Earth-boring tools include such a cutting element attached to a body. Methods of forming earth-boring tools include the attachment of such a cutting element to a body of an earth-boring tool.

U.S. Pat. No. 10,246,945 discloses an earth-boring tool includes a body having a face at a leading end thereof, blades extending from the body and including primary blades and secondary blades, and cutting elements on the blades and arranged in groups each including neighboring cutting elements. Some of the groups are disposed only on the primary blades in a first spiral configuration. Others of the groups disposed only on the secondary blades in a second, opposing spiral configuration. Methods of forming an earth-boring tool, and methods of forming a borehole in a subterranean formation are also described.

U.S. Pat. No. 10,753,155 discloses a bit for drilling a wellbore including: a body; and a cutting face including: a blade protruding from the body; and a row of cutters, each cutter including: a substrate mounted in a pocket formed adjacent to a leading edge of the blade; and a cutting table made from a superhard material, mounted to the substrate, and having a working face. A first subset of the row of cutters is oriented at a negative side rake angle. A second subset of the row of cutters is oriented at a zero or slightly positive side rake angle. The first and the second subsets are alternating. An innermost cutter of the first subset has a maximum absolute value of the negative side rake angle. The absolute value negative side rake angles of the rest of the cutters decrease as their distance from a center of the cutting face increases.

U.S. Pat. No. 11,480,016 discloses a drill bit including a body having a face and a plurality of blades disposed on the face of the body. Each of the plurality of blades may have a row of cutters disposed thereon, and the rows of cutters may collectively define a cutting profile of the drill bit. At least some of the cutters along the cutting profile may have alternating positive back rake angles. The difference between a majority of back rake angles on adjacent cutters along the cutting profile may be less than 20.

U.S. Pat. No. 11,802,444 discloses a bit for drilling a wellbore including: a body; and a cutting face. The cutting face includes: an inner section and an outer section; a plurality of blades protruding from the body, and a row of superhard cutters mounted along each blade, the cutters in the inner section having a negative profile angle and the cutters in the outer section having a positive profile angle. At least one of: at least one inner cutter is oriented at a negative side rake angle to create a weight on bit (WOB) reducing effect, and at least one outer cutter is oriented at a positive side rake angle to create the WOB reducing effect. Each of the rest of the cutters are oriented at a side rake angle such that an overall effect of the side rake angles is the WOB reducing effect.

US2019/0017328 discloses a drill bit mounted on or integral to a mandrel on the distal end of a downhole motor directional assembly. The drill bit is in a fixed circumferential relationship with the activating mechanism of one or more dynamic lateral pads (DLP). The technologies of the present application assist in and optionally control the extent of lateral movement of the drill bit. The technologies include, among other things, the placement and angulation of the cutting structures in the cone areas of the blades on the drill bit.

SUMMARY OF THE DISCLOSURE

The present disclosure generally relates to a drill bit with effective side rake for weight on bit reducing effect. In one embodiment, a bit for drilling a wellbore includes: a body; and a crown. The crown includes: a cone section and a shoulder section; a plurality of blades protruding from the body, each blade extending from a center of the crown and across the shoulder section; and a row of superhard cutters mounted along each blade, each cutter mounted in a pocket formed adjacent to a leading edge of the blade. Each row has a plurality of inner cutters located in the cone section. Each inner cutter has an inclined face oriented to decline toward the center of the crown for creating an effective negative side rake angle while drilling with the drill bit and a weight on bit (WOB) reducing effect. Each of the rest of the cutters are oriented such that an overall effect for the bit is the WOB reducing effect.

A bit for drilling a wellbore includes: a body; and a crown. The crown includes: a cone section and a shoulder section; a plurality of blades protruding from the body, each blade extending from a center of the crown and across the shoulder section; and a row of superhard cutters mounted along each blade, each cutter mounted in a pocket formed adjacent to a leading edge of the blade. Each row has a plurality of outer cutters located in the shoulder section. Each outer cutter has an inclined face oriented to decline away from the center of the crown for creating an effective positive side rake angle while drilling with the drill bit and a weight on bit (WOB) reducing effect. Each of the rest of the cutters are oriented such that an overall effect for the bit is the WOB reducing effect.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
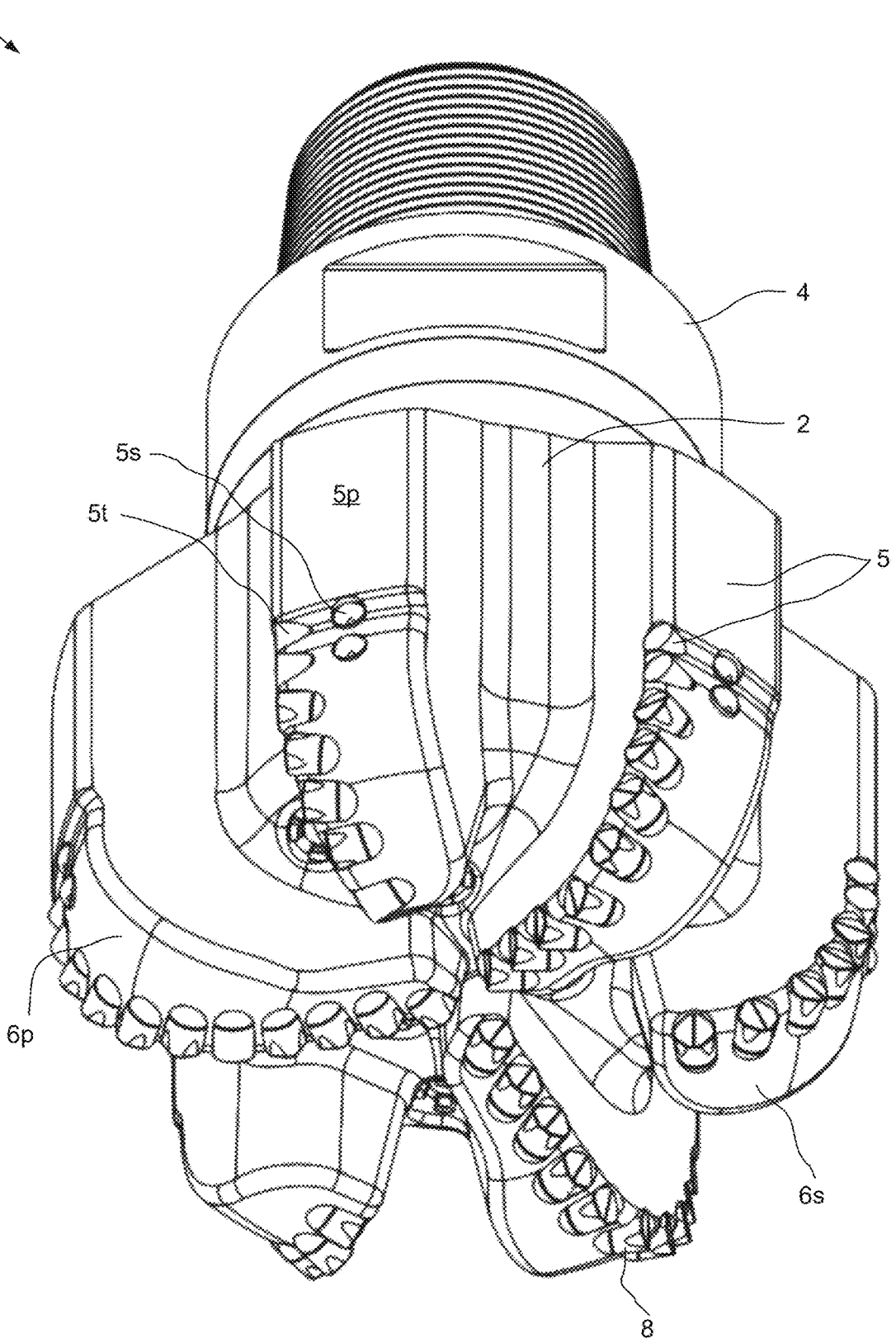
FIG. 1 illustrates a drill bit with an effective side rake for a weight on bit (WOB) reducing effect, according to one embodiment of the present disclosure.
Figure 2:
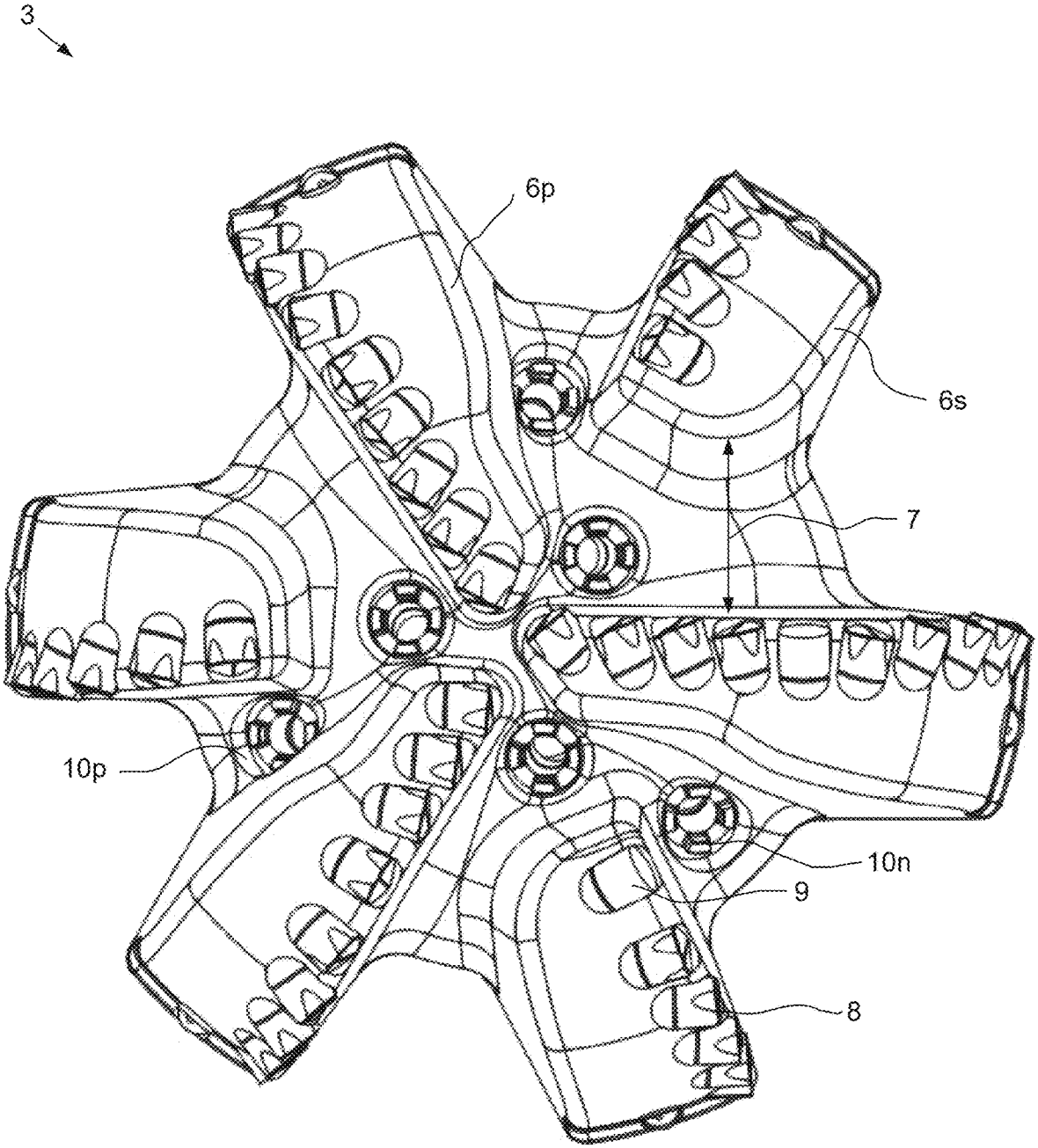
FIG. 2 illustrates a crown of the drill bit.
Figure 3:
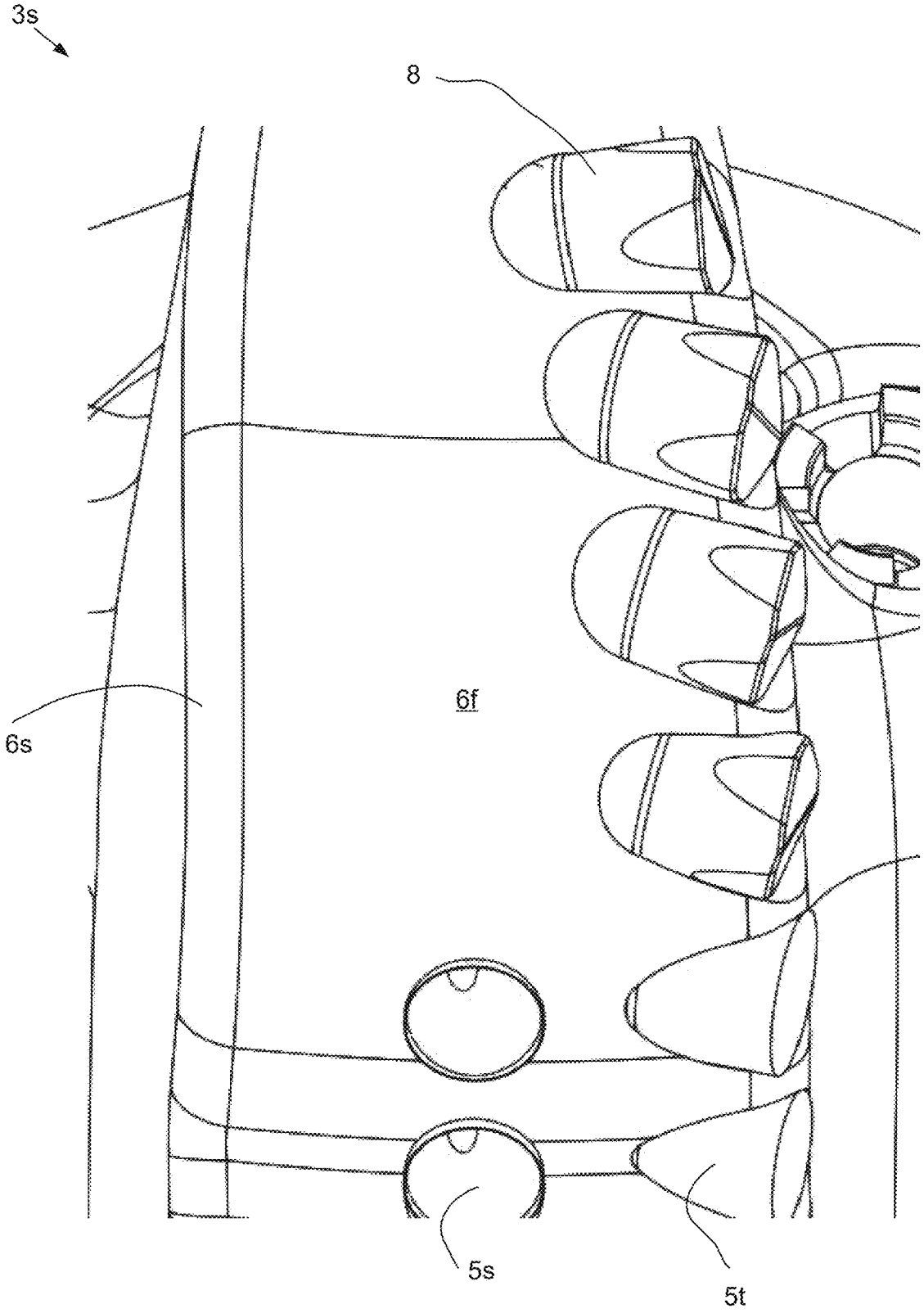
FIG. 3 illustrates a shoulder section of one of the blades of the drill bit.
Figure 4A:
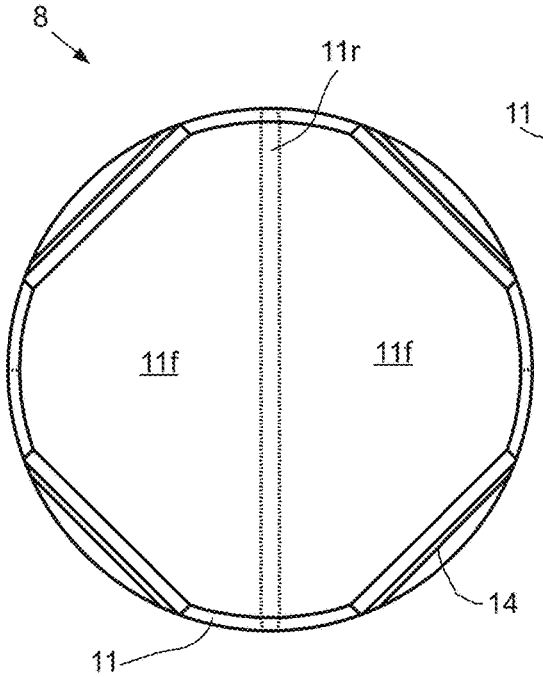
FIGS. 4A-4D illustrate a typical non-planar cutter of the drill bit.
Figure 4B:
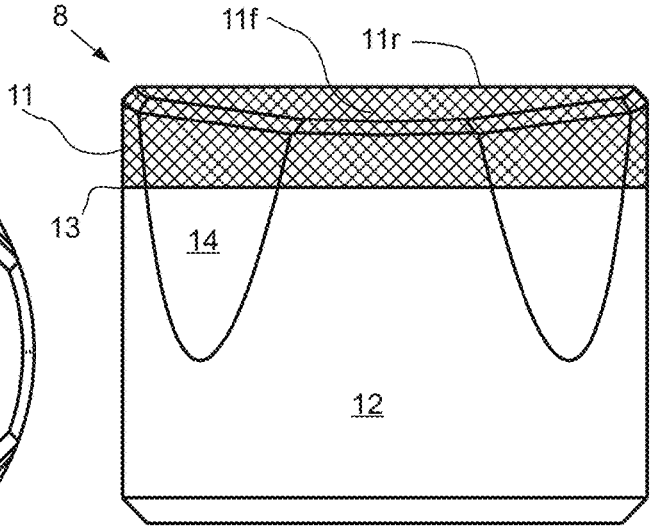
Figure 4C:
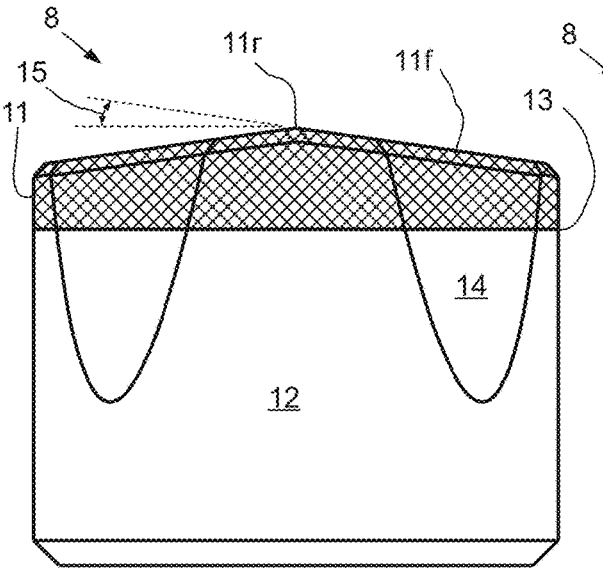
Figure 4D:
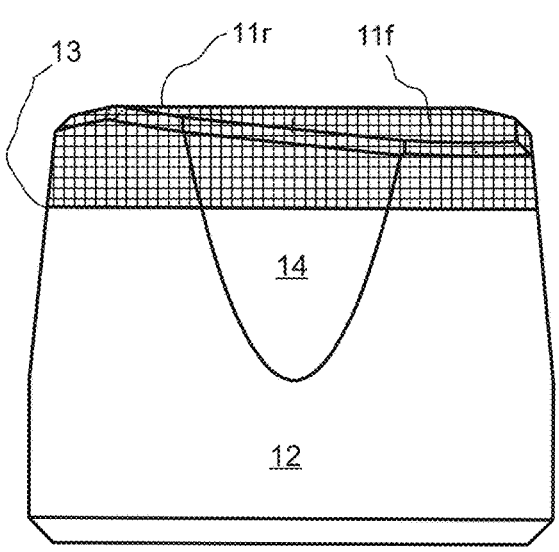

FIG. 1 illustrates a drill bit 1 with an effective side rake for a weight on bit (WOB) reducing effect, according to one embodiment of the present disclosure. FIG. 2 illustrates a crown 3 of the drill bit 1. FIG. 3 illustrates a shoulder section 3*s* of one of the blades 6*p,s* of the drill bit 1.

The drill bit 1 may include a bit body 2, the crown 3, a shank 4, and a gage section 5. A lower portion of the bit body 2 may be made from a composite material, such as a ceramic and/or cermet matrix powder infiltrated by a metallic binder, and an upper portion of the bit body may be made from a softer material than the composite material of the upper portion, such as a metal or alloy shoulder powder infiltrated by the metallic binder. The bit body 2 may be mounted to the shank 4 during molding thereof. The shank 4 may be tubular and made from a metal or alloy, such as steel, and have a coupling, such as a threaded pin, formed at an upper end thereof for connection of the drill bit 1 to a drill collar (not shown). The shank 4 may have a flow bore formed therethrough and the flow bore may extend into the bit body 2 to a plenum (not shown) thereof. The crown 3 may form a lower end of the drill bit 1 and the gage section 5 may form at an outer portion thereof.

Alternatively, the bit body 2 may be metallic, such as being made from steel, and may be hardfaced. The metallic bit body may be connected to a modified shank by threaded couplings and then secured by a weld or the metallic bit body may be monoblock having an integral body and shank.

The crown 3 may include one or more (three shown) primary blades 6*p*, one or more (three shown) secondary blades 6*s*, fluid courses 7 formed between the blades, and a row of non-planar cutters 8 mounted along each blade. The crown 3 may have one or more sections, such as an inner cone 3*c* (FIG. 5A), an outer shoulder 3*s*, and an intermediate nose 3*n* (FIG. 5A) between the cone and the shoulder sections. The blades 6*p*, s may be disposed around the crown 3 and each blade may be formed during molding of the bit body 2 and may protrude from a bottom of the bit body. The primary blades 6*p* and the secondary blades 6*s* may be arranged about the crown 3 in an alternating fashion. The primary blades 6*p* may each extend from a center 3*x* (FIG. 5A) of the crown 3, across a portion of the cone section 3*c*, across the nose 3*n* and shoulder 3*s* sections, and to the gage section 5. The secondary blades 6*s* may each extend from a periphery of the cone section 3*c*, across the nose 3*n* and shoulder 3*s* sections, and to the gage section 5. Each blade 6*p*, s may extend generally radially across the portion of the cone section 3*c* (primary only) and nose section 3*n* with a slight spiral curvature and across the shoulder section 3*s* radially and longitudinally with a slight helical curvature. Each primary blade 6*p* may be inclined in the cone section 3*c* by a cone angle which may range between five and forty-five degrees.

Alternatively, inner ends of the primary blades 4*p* at the center 3*x* may be connected by webs (not shown).

Each blade 6*p*, s may be made from the same material as the lower portion of the bit body 2. The non-planar cutters 8 may be mounted along leading edges of the blades 6*p,s* after infiltration of the bit body 2. The non-planar cutters 8 may be mounted, such as by brazing, in respective pockets formed in the blades 6*p*, s adjacent to the leading edges thereof. One of the primary blades 6*p* and one of the secondary blades 6*s* may have a planar cutter 9 mounted in respective pockets formed in the blades 6*p*, s adjacent to the leading edges thereof. Each blade 6*p*, s may have a bearing face 6*f* extending between a leading edge and a trailing edge thereof.

Alternatively, starting in the nose section 3*n* or shoulder section 3*s*, each blade 6*p,s* may have a row of backup pockets (not shown) formed in a bearing face 6*f* thereof and extending therealong. Each backup pocket may be aligned with or slightly offset from a respective leading pocket. Backup cutters (not shown) may be mounted, such as by brazing, in the backup pockets formed in the bearing faces 6*f* of the blades 6*p,s*. The backup cutters may be pre-formed, such as by high pressure and temperature sintering. The backup cutters may extend along at least the shoulder section 3*s* of each blade 6*p,s*.

One or more ports 10*p* may be formed in the bit body 2 and each port may extend from the plenum and through the bottom of the bit body to discharge drilling fluid (not shown) along the fluid courses 7. A nozzle 10*n* may be disposed in each port 10*p* and fastened to the bit body 2. Each nozzle 10*n* may be fastened to the bit body 2 by having a threaded coupling formed in an outer surface thereof and each port 10*p* may be a threaded socket for engagement with the respective threaded coupling. The ports 10*p* may include an inner set of one or more ports disposed in the cone section 3*c* and an outer set of one or more ports disposed in the nose section 3*n* and/or shoulder section 3*s*. Each inner port 10*p* may be disposed between an inner end of a respective secondary blade 6*s* and the center 3*x* of the crown 3.

The gage section 5 may define a gage diameter of the drill bit 1. The gage section 5 may include a plurality of gage pads 5*p*, such as one gage pad for each blade 6*p,s*, a plurality of gage trimmers 5*t*, and junk slots formed between the gage pads. The junk slots may be in fluid communication with the fluid courses 7 formed between the blades 6*p,s*. The gage pads 5*p* may be disposed around the gage section 5 and each pad may be formed during molding of the bit body 2 and may protrude from the outer portion of the bit body. Each gage pad 5*p* may be made from the same material as the bit body 2 and each gage pad may be formed integrally with a respective blade 6*p,s*. Each gage pad 5*p* may extend upward from a shoulder section 3*s* of the respective blade 6*p*, s to an exposed outer surface of the shank 4.

Each gage pad 5*p* may have a rectangular lower portion and a tapered upper portion. The tapered upper portions may transition an outer diameter of the drill bit 1 from the gage diameter to a lesser diameter of the shank 4. A taper angle may be the same for each upper portion and may range between thirty and sixty degrees as measured from a transverse axis of the drill bit 1. Each gage trimmer 5*t* may be mounted to a leading edge of each blade 6*p*, s adjacent to the respective gage pad 3*p* in the shoulder section 3*s*. The gage trimmers 5*t* may be mounted, such as by brazing, in respective pockets formed in the blades 6*p*, s adjacent to the leading edges thereof. Each gage trimmer 5*t* may be a superhard cutter similar to the planar cutter 9 (discussed below). The rectangular lower portions of the gage pads 5*p* may have flat outer surfaces.

The gage section 5 may further include a shock stud 5*s* protruding from the bearing face 6*f* of each blade 6*p,s* in the shoulder section 3*s* and each shock stud may be aligned with or slightly offset from a respective gage trimmer 5*t*. The gage trimmers 5*t* and associated shock studs 5*s* may have flats formed in outer surfaces thereof so as not to extend past the gage diameter of the drill bit 1.

Additionally, the gage pads 5*p* may have gage protectors (not shown) embedded therein. Each gage protector may be made from a superhard material, such as polycrystalline diamond or thermally stable polycrystalline diamond compact. An up-drill cutter (not shown) may be mounted in a pocket formed in a leading edge of each gage pad 5*p*. Each up-drill cutter may be a superhard cutter similar to the planar cutter 9 (discussed below).

Each planar cutter 9 and gage trimmer 5*t* may include a superhard cutting table, such as polycrystalline diamond (PCD), attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table. The working face of each planar cutter 9 and gage trimmer 5*t* may be smooth and flat.

Each cutter 8,9 and gage trimmer 5*t* may have a profile angle (not shown) relative to a longitudinal axis (not shown) of the drill bit 1. Each profile angle may be measured from a line parallel to the longitudinal axis to a line normal to the bit profile at a location of the tip of the respective cutter 8,9 and gage trimmer 5*t*. Each normal line may extend from the tip of the respective cutter 8,9 or gage trimmer 5*t* and away from the respective blade 6*p,s* or gage pad. Each profile angle may be positive in the clockwise direction and negative in the counter-clockwise direction. For each primary blade 6*p*, the cutters 8 in the cone section 3*c* have a negative profile angle, the cutters 8 and gage trimmers 5*t* in the shoulder section 3*s* have a positive profile angle, and the cutters 8,9 in the nose section 3*n* have a zero or almost zero profile angle. The cutters 8 in the cone section 3*c* have a negative profile angle due to the cone angle thereof and the cutters in the shoulder region 3*s* have a positive profile angle due to the curvature thereof. The cutters 8,9 in the nose section 3*n* can any of a positive profile angle, a negative profile angle, or a zero profile angle depending on the radial distance from the center 3*x* of the crown 3.

The cutters 8 of each primary blade 6*p* in the cone section 3*c* may be oriented at a negative side rake angle. The cutters 8 of each blade 6*p*, s in the shoulder section 3*s* may be oriented at a positive side rake angle. The side rake angle may be defined by an inclination of a through axis of each cutter 8 relative to a respective line tangent to a respective radial line extending from the center 3*x* of the crown 3 to a respective center of the working face of the respective cutter about a respective inclination axis (not shown) normal to a respective projection (not shown) of the bearing face 6*f* of the respective blade 6*p,s* at the center of the working face. In the view of FIG. 2, the polarity of the side rake angle is negative for the counter-clockwise direction and positive for the clockwise direction or negative if the working face of the cutter 8 is tilted inward toward the center 3*x* of the crown 3 and positive if the cutter is tilted outward away from the center of the cutting face.

The rest of the cutters 8,9 and gage trimmers 5*t* of the drill bit 1 may be oriented at a zero (or almost zero) side rake angle. An absolute value of the side rake angle of the cutters 8 may range between five and thirty degrees. Each cutter 8,9 and gage trimmer 5*t* may be fixed to the bit body 2 such that each cutter 8,9 and gage trimmer 5*t* does not rotate relative to the bit body while drilling with the drill bit 1.

In use (not shown), the drill bit 1 may be assembled with one or more drill collars, such as by threaded couplings, thereby forming a bottomhole assembly (BHA). The BHA may be connected to a bottom of a pipe string, such as drill pipe or coiled tubing, thereby forming a drill string. The BHA may further include a steering tool, such as a bent sub or rotary steering tool, for drilling a deviated portion of the wellbore. The pipe string may be used to deploy the BHA into the wellbore. The drill bit 1 may be rotated, such as by rotation of the drill string from a rig (not shown) and/or by a drilling motor (not shown) of the BHA, while drilling fluid, such as mud, may be pumped down the drill string. A portion of the weight of the drill string may be set on the drill bit 1. The drilling fluid may be discharged by the nozzles 10*n* and carry cuttings up an annulus formed between the drill string and the wellbore and/or between the drill string and a casing string and/or liner string.

As discussed in more detail in U.S. Pat. No. 11,802,444, which is incorporated by reference to the extent that it does not conflict with the teachings herein, for each of the side raked cutters 8, a significant lateral force is generated during drilling and the projection of lateral force onto the longitudinal axis opposes the projection of the normal force along the longitudinal axis. In other words, for each of the side raked cutters 8, a driving force which goes in the same direction as the movement of the drill bit 1 is generated while drilling the rock. This driving force reduces the WOB, or in other words, has a WOB reducing effect. Thus, any cutter 8 having a negative profile angle (cutters in the cone section 3*c*) and a negative side rake angle has a WOB reducing effect and any cutter having a positive profile angle (cutters in the shoulder section 3*s*) and a positive side rake angle has a WOB reducing effect. Conversely, any cutter 8 having a negative profile angle and a positive side rake angle will tend to negate the WOB reducing effect and any cutter having a positive profile angle and a negative side rake angle will tend to negate the WOB reducing effect.

FIGS. 4A-4D illustrate a typical non-planar cutter 8 of the drill bit 1. The typical non-planar cutter 8 may include a non-planar cutting table 11 mounted to a cylindrical substrate 12. The cutting table 11 may be made from a superhard material, such as polycrystalline diamond, and the substrate 12 may be made from a hard material, such as a cermet, thereby forming a compact, such as a polycrystalline diamond compact. The cermet may be a cemented carbide, such as a Group VIIIB metal-tungsten carbide. The Group VIIIB metal may be cobalt.

The cutting table 11 may have an interface 13 with the substrate 12 at a lower end thereof and the working face at an upper end thereof. The working face may have a peripheral edge and a ridge 11*r* protruding a height above the substrate 12 and a pair of opposed inclined faces 11*f* extending laterally away from the ridge. The ridge 11*r* may be centrally located in the working face and extend across the working face. The presence of the ridge 11*r* may result in the peripheral edge undulating with peaks and valleys. The portion of the ridge 11*r* adjacent to the peripheral edge may be an operative portion. Since the ridge 11*r* extends across the working face, the ridge may have two operative portions. An inclination angle 15 of each face 11*f* may range between five and forty-five degrees. The inclined faces 11*f* may each continuously decrease in height in a direction away from the ridge 11*r* to the peripheral edge that is the valley of the undulation thereof. The ridge 11*r* and recessed regions may impart a parabolic cylinder shape to the working face. The peripheral edge of the cutting table 11 may be chamfered. The inclination of the faces 11*f* may be linear (shown) or curved, such as concave.

The typical non-planar cutter 8 may initially be formed with a cylindrical shape, such as by high pressure and high temperature sintering. Once sintered, two pairs of recesses, such as flats 14, may be machined into the periphery of the typical non-planar cutter 8 to impart a scribe-shape. The machining may be done by electrical discharge machining or with a laser. The flats 14 may each be formed along both the substrate 12 and the cutting table 11. Each pair of flats 14 may straddle the ridge 11*r*. The scribe shape may include a rounded or sharp operative edge. The typical non-planar cutter 8 may primarily be a shear cutter with some plowing action provided by the ridge 11*r*.

Figure 5A:
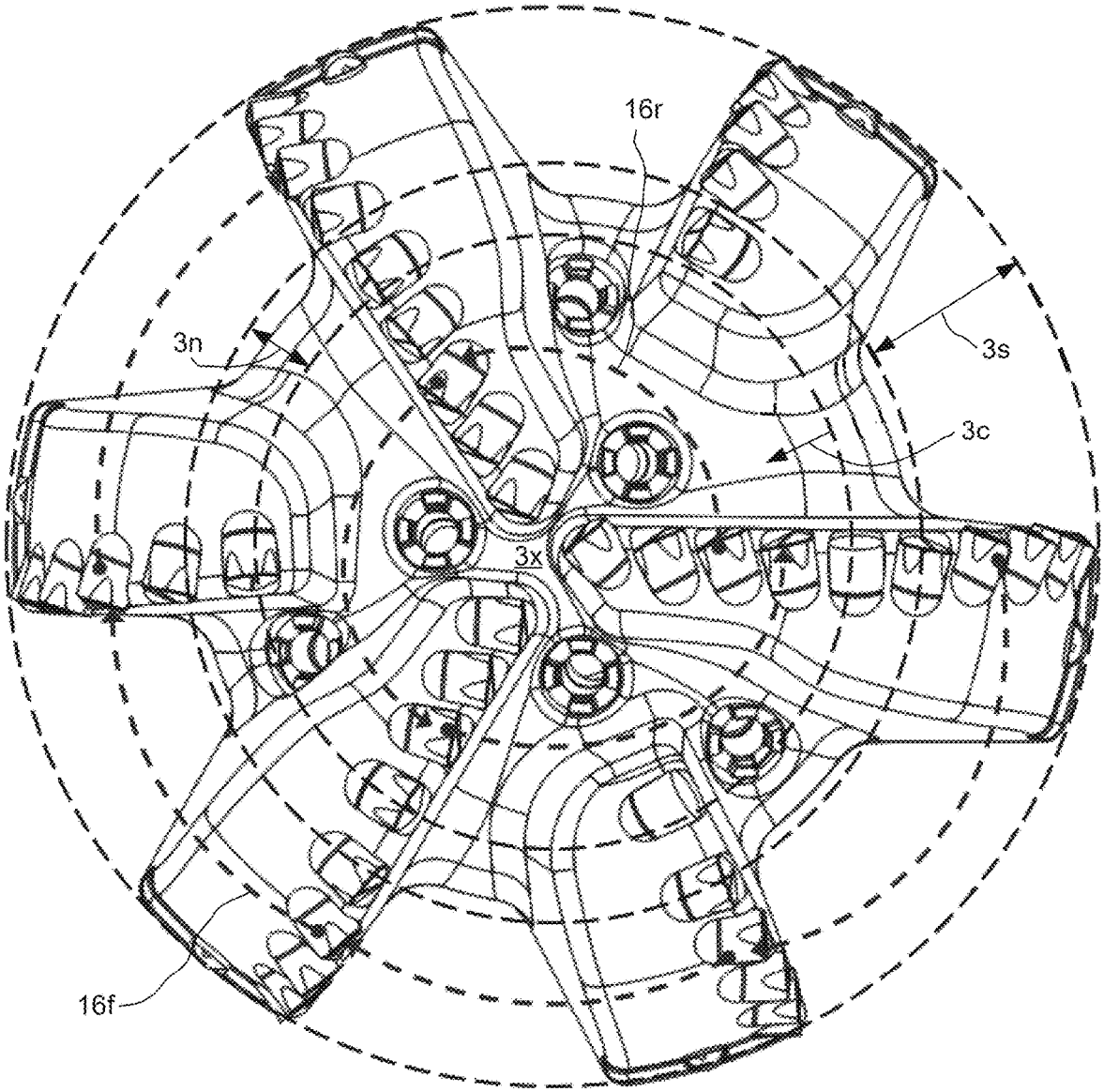
FIG. 5A illustrate a spiral layout of the cutters of the drill bit.

FIG. 5A illustrate a spiral layout of the cutters 8,9 of the drill bit 1. The non-planar cutters 8 in the cone section 3*c* may be arranged in a reverse spiral layout 16*r*. The non-planar cutters 8 in the shoulder section 3*s* may be arranged in a forward spiral layout 16*f*. The cutters 8,9 in the nose section 3*n* may be arranged to transition between the forward 16*f* and reverse 16*r* spiral layouts. The forward spiral layout 16*f* refers to a cutter placement where cutters having incrementally increasing radial distances from the center 3*x* of the crown 3 are placed in a clockwise distribution, whereas a reverse spiral layout 16*r* refers to a cutter placement where cutters having incrementally increasing radial distances from the center 3*x* of the crown 3 are placed in a counter-clockwise distribution.

Each of the non-planar cutters 8 in the cone section 3*c* may be oriented such that that an inner one of the inclined faces 11*f* declines toward the center 3*x* of the crown 3. Each of the non-planar cutters 8 in the shoulder section 3*s* may be oriented such that that an inner one of the inclined faces 11*f* declines away from the center 3*x* of the crown 3.

Alternatively, the cutters 8,9 in the nose 3*n* and shoulder section 3*s* may have a reverse spiral layout 16*r* instead of a transitional and forward 16*f* spiral layouts such that the bit only has a reverse spiral layout.

Figure 5B:
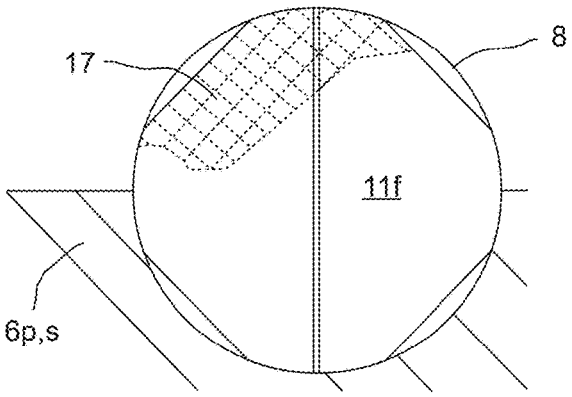
FIG. 5B illustrates an asymmetric distribution of the cutting area of the typical non-planar cutter due to a forward spiral cutter layout.
Figure 5C:
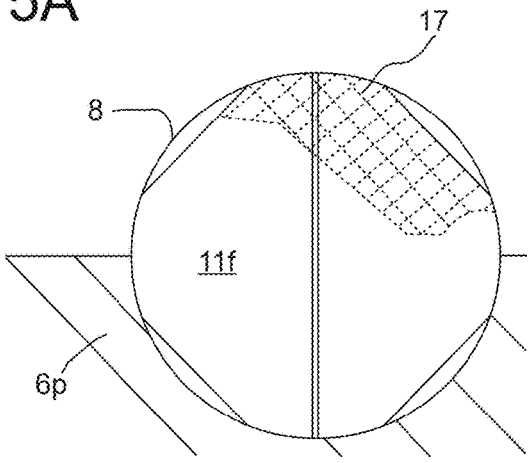
FIG. 5C illustrates an asymmetric distribution of the cutting area of the typical non-planar cutter due to a reverse spiral cutter layout.

FIG. 5B illustrates an asymmetric distribution of the cutting area 17 of the typical non-planar cutter 8 due to the forward spiral cutter layout 16*f*. FIG. 5C illustrates an asymmetric distribution of the cutting area 17 of the typical non-planar cutter 8 due to a reverse spiral cutter layout 16*r*. Due to the inclination 15 of the faces 8*f*, an effective side rake angle will be created during drilling with the drill bit 1 corresponding to the inclination angle 15 of the inclined faces 11*f*. The cutting area 17 on an inner one of the faces 11*f* will generate a negative effective side rake angle and the cutting area on an outer one of the faces 11*f* will generate a positive effective side rake angle. If the cutting area 17 is symmetrically distributed between the inner and outer faces, negation of the effective side rake angle will occur. However, the spiral layout of the non-planar cutters leads to an asymmetric distribution of the cutting area 17 with a concentration on the outer one of the faces 11*f* for the forward spiral layout 16*f* and the concentration on the inner one of the faces 11*f* for the reverse spiral layout 16*r*. The concentration of the cutting area 17 shown is remarkable such as the concentrated face 11*f* having substantially more cutting area than the deficient face, such as a ratio ranging between one point five and three. The concentration of the cutting area 17 will create a net effective side rake angle: negative for the reverse spiral layout and positive for the forward spiral layout.

Advantageously, the net effective side rake angle may be used to enhance the WOB reducing effect of the (actual) side rake of the non-planar cutters 8.

Alternatively, the non-planar cutters 8 may have a zero or near zero actual side rake and the net effective side rake angle may be used solely to create the WOB reducing effect.

Figure 6A:
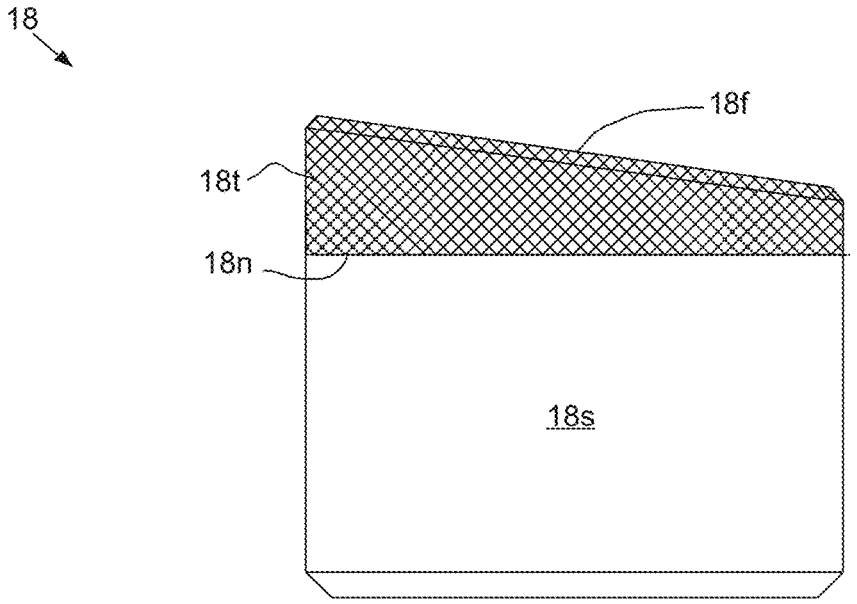
FIG. 6A illustrates an alternative non-planar cutter for use with the drill bit.

FIG. 6A illustrates an alternative non-planar cutter 18 for use with the drill bit 1. An alternative non-planar cutter 18 may be mounted to each of the respective pockets in the blades 6*p,s* instead of the respective non-planar cutter 8 in the orientation discussed below. The non-planar cutter 18 may include a non-planar cutting table 18*t*mounted to a cylindrical substrate 18*s*. The cutting table 18*t* may be made from a superhard material, such as polycrystalline diamond, and the substrate 18*s* may be made from a hard material, such as a cermet, thereby forming a compact, such as a polycrystalline diamond compact. The cermet may be a cemented carbide, such as a Group VIIIB metal-tungsten carbide. The Group VIIIB metal may be cobalt.

The cutting table 18*t* may have an interface 18*n* with the substrate 18*s* at a lower end thereof and an inclined face 18*f* at an upper end thereof. The inclined face 18*f* may have a peripheral edge and may extend across the cutting table 18*t*. An inclination angle of the face 18*f* may range between five and forty-five degrees. The peripheral edge of the cutting table 18*t* may be chamfered. The alternative non-planar cutter 18 may be a shear cutter. The inclination of the face 18*f* may be linear (shown) or curved, such as concave.

Figure 6B:
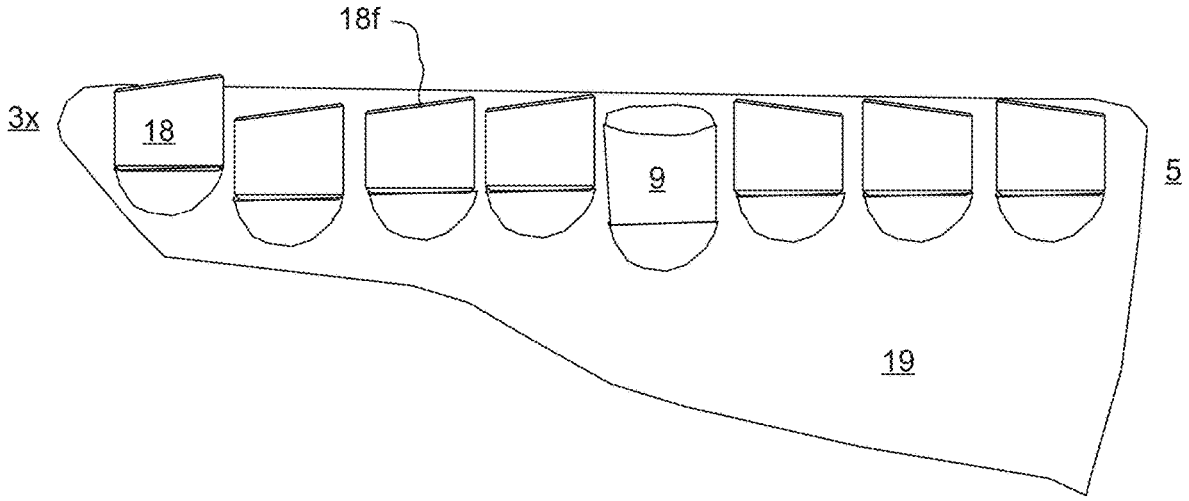
FIG. 6B illustrates an orientation of several of the alternative non-planar cutters along a blade of an alternative drill bit.

FIG. 6B illustrates an orientation of several of the alternative non-planar cutters 18 along a blade 19 of an alternative drill bit. For the cone section of the blade 19 (left of the planar cutter 9), each alternative non-planar cutter 18 may be oriented such that the inclined face 18*f* declines toward the center 3*x* of the crown to generate a negative effective side rake angle during drilling. For the shoulder section of the blade 19 (right of the planar cutter 9), each alternative non-planar cutter 18 may be oriented such that the inclined face 18*f* declines away from the center 3*x* of the crown to generate a positive effective side rake angle during drilling. Since each alternative non-planar cutter 18 only has one inclined face in one direction, this orientation will generate the effective side rake angle regardless of the cutter layout of the alternative drill bit (forward spiral, reverse spiral, or other type of layout). The actual side rake angle of each alternative non-planar cutter 18 may be zero (as shown) or according to that of the drill bit 1, discussed above.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:
a body; and
a crown comprising:
a cone section and a shoulder section;
of at least three blades protruding from the body, each blade extending from a center of the crown and across the shoulder section; and
a row of superhard cutters mounted along each blade, each cutter mounted in a pocket formed adjacent to a leading edge of the blade,
wherein:
each row has a plurality of inner cutters located in the cone section,
each inner cutter has an inclined face oriented to decline toward the center of the crown for creating an effective negative side rake angle while drilling with the drill bit and a weight on bit (WOB) reducing effect,
each of the rest of the cutters are oriented such that an overall effect for the bit is the WOB reducing effect,
each inclined face is a first inclined face,
each inner cutter has a central ridge and a second inclined face opposed to the first inclined face,
the inner cutters are arranged in a reverse spiral layout to concentrate a cutting area on the first inclined faces, and
the effective negative side rake angle is a net effective negative side rake angle.

2. The bit of claim 1, wherein each inner cutter is also oriented at a negative side rake angle.

3. The bit of claim 2, wherein an absolute value of the side rake angle ranges between 5 and 30 degrees.

4. The bit of claim 1, wherein:
each row has a plurality of outer cutters located in the shoulder section, and
each outer cutter has an inclined face oriented to decline away from the center of the crown for creating an effective positive side rake angle while drilling with the drill bit and a weight on bit (WOB) reducing effect.

5. The bit of claim 4, wherein:
each inclined face of the respective outer cutter is a first inclined face,
each outer cutter has a central ridge and a second inclined face opposed to the first inclined face,
the outer cutters are arranged in a forward spiral layout to concentrate a cutting area on the first inclined faces, and
the effective positive side rake angle is a net effective positive side rake angle.

6. The bit of claim 4, wherein each outer cutter is oriented at a positive side rake angle.

7. The bit of claim 1, wherein:
each row has a plurality of outer cutters located in the shoulder section,
each inner cutter is oriented at a side rake angle of about or less than zero, and
each outer cutter is oriented at a side rake angle of about or greater than zero.

8. The bit of claim 1, wherein each inner cutter is a shear cutter.

9. The bit of claim 1, wherein each cutter is fixed to the bit body such that each cutter does not rotate relative to the bit body while drilling with the drill bit.

10. A bit for drilling a wellbore, comprising:
a body; and
a crown comprising:
a cone section and a shoulder section;
at least three blades protruding from the body, each blade extending from a center of the crown and across the shoulder section; and
a row of superhard cutters mounted along each blade, each cutter mounted in a pocket formed adjacent to a leading edge of the blade,
wherein:
each row has a plurality of outer cutters located in the shoulder section,
each outer cutter has an inclined face oriented to decline away from the center of the crown for creating an effective positive side rake angle while drilling with the drill bit and a weight on bit (WOB) reducing effect, each of the rest of the cutters are oriented such that an overall effect for the bit is the WOB reducing effect, each inclined face is a first inclined face, each outer cutter has a central ridge and a second inclined face opposed to the first inclined face, the outer cutters are arranged in a forward spiral layout to concentrate a cutting area on the first inclined faces, and the effective positive side rake angle is a net effective positive side rake angle.

11. The bit of claim 10, wherein each outer cutter is also oriented at a positive side rake angle.

12. The bit of claim 11, wherein an absolute value of the side rake angle ranges between 5 and 30 degrees.

13. The bit of claim 10, wherein each cutter is fixed to the bit body such that each cutter does not rotate relative to the bit body while drilling with the drill bit.

14. A bit for drilling a wellbore, comprising:

a body; and a crown comprising:

a cone section and a shoulder section;

a plurality of blades protruding from the body, each blade extending from a center of the crown and across the shoulder section; and a row of superhard cutters mounted along each blade, each cutter mounted in a pocket formed adjacent to a leading edge of the blade, wherein:

each row has a plurality of inner cutters located in the cone section, each inner cutter has an inclined face oriented to decline toward the center of the crown for creating an effective negative side rake angle while drilling with the drill bit and a weight on bit (WOB) reducing effect, each of the rest of the cutters are oriented such that an overall effect for the bit is the WOB reducing effect, and each inner cutter only has one inclined face in one direction extending across a cutting table thereof.

15. The bit of claim 14, wherein each inner cutter is also oriented at a negative side rake angle.

16. The bit of claim 14, wherein each cutter is fixed to the bit body such that each cutter does not rotate relative to the bit body while drilling with the drill bit.

17. A bit for drilling a wellbore, comprising:

a body; and a crown comprising:

a cone section and a shoulder section;

a plurality of blades protruding from the body, each blade extending from a center of the crown and across the shoulder section; and a row of superhard cutters mounted along each blade, each cutter mounted in a pocket formed adjacent to a leading edge of the blade, wherein:

each row has a plurality of outer cutters located in the shoulder section, each outer cutter has an inclined face oriented to decline away from the center of the crown for creating an effective positive side rake angle while drilling with the drill bit and a weight on bit (WOB) reducing effect, each of the rest of the cutters are oriented such that an overall effect for the bit is the WOB reducing effect, and each outer cutter only has one inclined face in one direction extending across a cutting table thereof.

18. The bit of claim 17, wherein each inner cutter is also oriented at a negative side rake angle.

19. The bit of claim 17, wherein each cutter is fixed to the bit body such that each cutter does not rotate relative to the bit body while drilling with the drill bit.

* * * * *